United States Patent [19]

Drevet

[11] Patent Number: 4,815,327

[45] Date of Patent: Mar. 28, 1989

[54] ROTARY BARREL MACHINE WITH PISTONS AND FIXED CENTERING PIVOT

[76] Inventor: Michel Drevet, 75 Rue Ernest Renan, Sevres - Hauts de Seine, France

[21] Appl. No.: 918,466

[22] Filed: Oct. 14, 1986

[30] Foreign Application Priority Data

Oct. 14, 1985 [FR] France ..... 85 15604

[51] Int. Cl.[4] ..... F16H 23/02; F16H 23/08

[52] U.S. Cl. ..... 74/60; 74/839; 417/269

[58] Field of Search ..... 74/60, 839; 91/12.2; 417/269, 270, 271

[56] References Cited

U.S. PATENT DOCUMENTS

| | | | |
|---|---|---|---|
| Re. 27,844 | 12/1973 | Olson | 417/269 |
| 1,331,035 | 2/1920 | Soemer | 74/60 |
| 2,022,290 | 11/1935 | Large | 74/424 |
| 2,127,773 | 8/1938 | Horton | 74/60 |
| 2,737,894 | 3/1956 | Ferris | 417/269 |
| 2,821,932 | 2/1958 | Lucien | 417/269 |
| 2,940,325 | 6/1960 | Nakesch | 74/60 |
| 2,955,475 | 10/1960 | Zubaty | 417/269 |
| 3,010,339 | 11/1961 | Brock | 74/60 |
| 3,069,913 | 12/1962 | McCrory et al. | 74/60 |
| 3,171,509 | 3/1965 | Girodin | 74/60 |
| 3,180,159 | 4/1965 | Girodin | 74/60 |
| 3,223,042 | 12/1965 | Thresher | 74/60 |
| 3,911,791 | 10/1975 | Clerk | 74/60 |
| 4,106,354 | 8/1978 | Girodin | 74/60 |
| 4,513,630 | 4/1985 | Pere et al. | 92/12.2 |

FOREIGN PATENT DOCUMENTS

| | | | |
|---|---|---|---|
| 885831 | 6/1943 | France | 417/269 |
| 2271459 | 12/1975 | France | 74/60 |
| 2572774 | 5/1986 | France . | |

*Primary Examiner*—Allan D. Herrmann

*Attorney, Agent, or Firm*—Browdy & Neimark

[57] ABSTRACT

The invention relates to a pump with a barrel and an oscillating plate having a fixed central pivot. The pivot is solidary with two half-shafts which may be axially prstressed.

The invention creates a balanced floating thrust bearing for the pivot bearing.

10 Claims, 3 Drawing Sheets

30
100
67
68
70
69
84
85
103
99
106
107
102
102
105
104
99
101
86

ROTARY BARREL MACHINE WITH PISTONS AND FIXED CENTERING PIVOT

FIELD OF THE INVENTION

This invention concerns a rotating piston machine of the barrel type, more particularly designed to discharge fluids at high pressure, especially heavy liquids.

BACKGROUND OF THE INVENTION

It is known that pumps of this type are commonly used in the mining or petroleum industry for pumping heavy liquids such as petroleum, liquid slurries, fracturation fluids and the like. Pumps of this type are usually large in size and designed to discharge liquids at a high flow rate under high pressure, usually more than 200 bars.

In the particular case of petroleum operations, it is also necessary for a pump of this type to be relatively small in size, sufficiently so to allow it to be loaded and transported on a truck along with its drive motor. Therefore, it is understandable that the trend is to reduce the weight and overall size of the pump while increasing its liquid discharge pressure. Solutions known to date (and described for example in Girodin and Pere U.S. Pat. Nos. 4,106,354, 4,513,630, as well as in French specification Nos. 885,831 to Lefftz and 2,271,459 to Creusot-Loire) consist in using a barrel-type piston pump with the piston linkage controlled from a rotating inclined plane, the rotating inclined plane resting on thrust bearings at the bottom of the pump housing, which encloses the linkage.

In practice, it is reported that this known technique has a serious disadvantage. In fact, the pump external housing transmits the thrust forces between the rear thrust bearings of the rotating oscillating plate and the barrel into whose cylinders the liquid is discharged by the pistons. In other words, the higher the discharge pressure, the greater the stresses transmitted by the housing, thus requiring a large and heavy housing. The pumps now known have thus reached a limit beyond which it is impossible to increase the liquid pressure without increasing the weight and size of the pump and drive motor assembly, which then becomes quite impossible to transport by truck.

French specification No. 2,572,774 to the present applicant has taught an embodiment preventing some of these disadvantages by having a rotating machine with a barrel and a rotating inclined plane supplied with a new type of linkage making it possible to increase the liquid discharge pressure while reducing the overall weight of the pump and drive motor assembly.

A rotating machine according to French specification No. 2,572,774 to the present applicant and U.S. Pat. No. 4,106,354 to Girodin contains a fixed barrel having cylindrical bores into which run discharge pistons, each of which is connected by a rod to an inclined plane with an oscillatory tacking movement, whose rear surface is equipped with a drive journal perpendicular to the front thrust surface of the plate. The plate has a spherical bearing whose circular meridian forms a center angle of at least 180°, while inside the spherical bearing is a fixed spherical pivot solidary with an arm anchored axially in the center of the barrel, so that the thrust of the plate during operation is transmitted directly to the barrel through the spherical bearing which makes a pulling action, without involving the strength of the housing walls, particularly in the rear portion.

OBJECTS AND SUMMARY OF THE INVENTION

The present invention relates to new improvements having particularly for their purpose to ensure that the central bearing will work in substantially balanced conditions.

The new arrangement according to the invention cancels the overhang of the central pivot, which prevents a breaking of the shaft supporting the central pivot, such breaking being possibly caused by a mechanical fatigue due to the heavy rotating loads.

The invention therefore more particularly relates to a piston and barrel rotary machine comprising a thrust plate inclined with respect to a geometric rotation axis which is same as a geometric axis of the barrel, a central part of the inclined plate comprising a spherical bearing which freely rotates around a central fixed pivot, the central fixed pivot being solidary with a first half shaft directly anchored in the central part of the barrel, the barrel being connected to a peripheral housing covering a rear portion of a rodding behind which it closes, and wherein the central pivot is besides solidary with a second half shaft placed opposite the first half shaft with which it is aligned on the geometric axis of the barrel, said second half shaft having an opposed end rigidly anchored onto a rear part of the housing.

BRIEF DESCRIPTION OF THE DRAWINGS

The attached drawings, given as a non limitative example, will provide a better understanding of the invention.

DETAILED DESCRIPTION OF THE INVENTION

Figure 1:
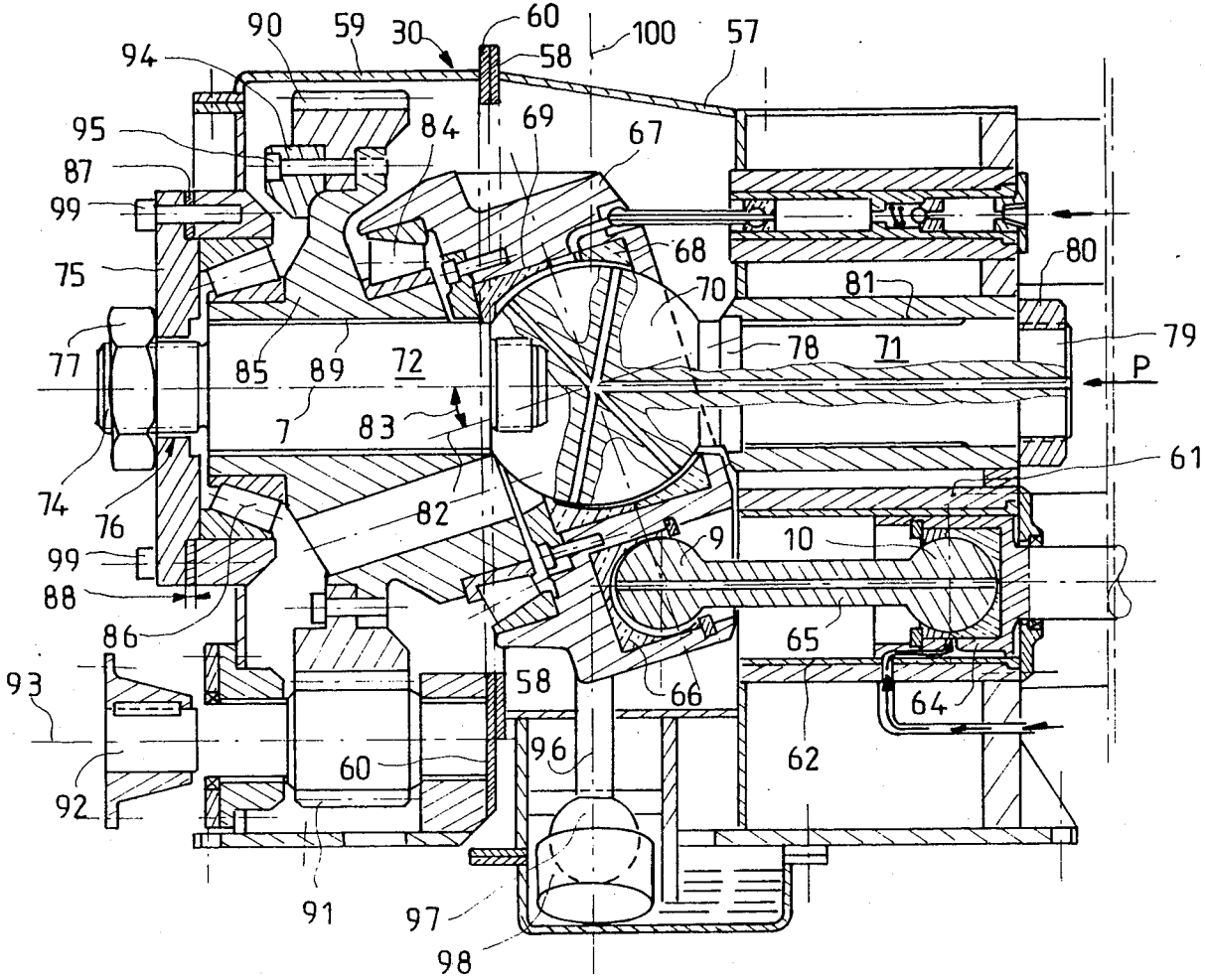
FIG. 1 is an axial cross-section of a barrel pump according to the invention.

The drawings represent a barrel pump which includes:

a fixed barrel 61, in the bores 62 of which tie-bars or pistons 64 slide in a reciprocal movement;

an inclined plate 67, whose geometric axis 82 forms an acute angle 83 with the geometric axis 7 of the barrel 61 and which is provided to have an oscillatory tacking movement;

rods 65, each of which has two spherical ends 9 and 10, to connect each tie-bar or piston 64 with the plate 67;

a control pinion 90 which rotates on the geometric axis 7;

a lateral gear 71, which meshes with the gear teeth of the control pinion gear 90 and having a shaft 92, which is driven by a motor reducer, not shown.

The invention is particularly applicable to compressors, pumps or hydraulic motors with axial pistons, for heavy fluids.

According to Figure 1, the pump housing 30 is divided into two parts, a part 57 equipped with a flange 58 and an other part 59 with a mating flange 60 to connect them together; the two flanges 58 and 60 are circular and centered on the axis 7 of the machine, which makes it possible to change their relative angular position in steps. The angular position of the drive shaft 92 around the geometric axis 7 of the machine can thus be selected at will.

FIGS. 1 to 4 represents a rotating machine, for example a pump, with a fixed barrel 61 containing parallel bores 62 distributed around the geometric axis 7 of the unit. In each bore 62 slides a piston 64 having a rod 65 which is supported by a bearing 66 on an inclined oscillating-tacking plate 67. At its center, the plate 67 has a spherical bearing 68, 69, engaged around the sphere of a fixed pivot 70.

According to the invention, the fixed pivot 70 is solidary with a first half-shaft 71 and a second half-shaft 72, between which it is located. The two half-shafts 71 and 72 are aligned with one another on either side of the pivot 70 and are both centered on the longitudinal centerline of the pump machine. The two half-shafts 71 and 72 may sometimes form only a single, rigid, one-piece shaft.

The first half-shaft 71 is fixed in the central portion of the barrel 61.

The second half-shaft 72 is solidary with the rear portion 59 of the pump housing 30.

More specifically, the second half-shaft 72 extends to the rear in a threaded pin 74 which passes freely through a central orifice 76 in the back cover 75. A nut 77 screwed onto the threaded pin 74 outside the cover 75 makes it possible to fasten the second half-shaft 72 in order to stiffen the housing 30.

In a like manner, on the first half-shaft 71, near the pivot 70, there is a shoulder 78 supported on the inside surface of the barrel 61, while at the front of the barrel 61 the half-shaft 71 extends in a threaded pin 79 on which a nut 80 can be screwed to the desired extent. It is obvious that the tensile stresses to which the half-shaft 71 is subjected can be taken up by acting on the nut 80, since the edge of the nut 80 rests on the front surface of the barrel 61.

The central portion of the half-shaft 71 is positioned in a central bore 81 in the barrel 61, where it can freely slide in a lengthwise direction.

The front thrust surface of the plate 67 is perpendicular to a geometric axis 82 which forms an acute angle 83 with the geometric axis 7. The two geometric axes 7 and 82 converge towards the center 90 of the spherical pivot 70. The plate 67 rotates around the geometric axis 82 and, for this reason, the rear surface of the plate 67 rests on a conical roller thrust bearing 84 on a movement transmitter 85. The movement transmitter 85 rests in turn, through a roller thrust bearing 86, on the rear cover 75 of the housing 30. This rear cover 75 of the housing 30 is screwed onto the housing 30 with insertion of an annular adjusting shim 87 having a thickness 88 which can be selected at will based on the desired prestress.

A longitudinal bore 89 is provided through the central portion of the movement transmitter 85, inside which the second half-shaft 72 moves freely.

On the edge of the movement transmitter 85 is a toothed pinion 90, centered on the geometric axis 7. The pinion 90 meshes with a smaller-diameter control pinion 91 located laterally in the housing 30 and solidary with a rotating output shaft 92 located outside. The geometric axis 93 of the output shaft 92 is parallel to the geometric axis 7. A balance block 94 is fastened to the pinion 90 by screws 95.

Finally, a lateral rod 96 is articulated at one end 97 thereof (FIG. 1) in a bearing 98, solidary with the plate 67 which is thus immobilized in rotation.

It is apparent that the linkage thus represented, and particularly the structure of the movement transmitter 85, have the advantage of allowing an axial compression of the roller thrust bearings 84 and 86 due to the adjusting shim 87 which is compressed by the rear cover 75, which is in turn fastened to the bottom of the housing 30 by screws 99 and by the nut 77. In particular, the thickness 88 of the adjusting shim 87 is carefully selected so as to apply a prestress to the thrust bearings 84 and 86 which will be taken up by the portion of the half-bearings 68 and 69 located to the left of the theoretical cross-sectional plane 100 defined by the spherical pivot 70. The prestress will thus relieve the other portion of the half-bearings 68 and 69 located to the right of the theoretical plane 100 and receives the thrust forces exerted by the pistons 64. Thus, the specific pressures appearing during operation of the machine are appropriately distributed all around the spherical cover of the half-bearings 68 and 69. A sensible choice would be to calculate the thickness 88 of the adjusting shim 87 so that the stresses to the right and left of the cross-sectional plane 100 will create equal pressures on the spherical cover of the central bearing 68, 69. If this condition is met, it can be said that the machine has a so-called 'floating thrust bearing' at its center, since at this position of equilibrium, the spherical thrust bearing (bearing 68, 69 on pivot 70) is under a zero axial load.

Figure 4:
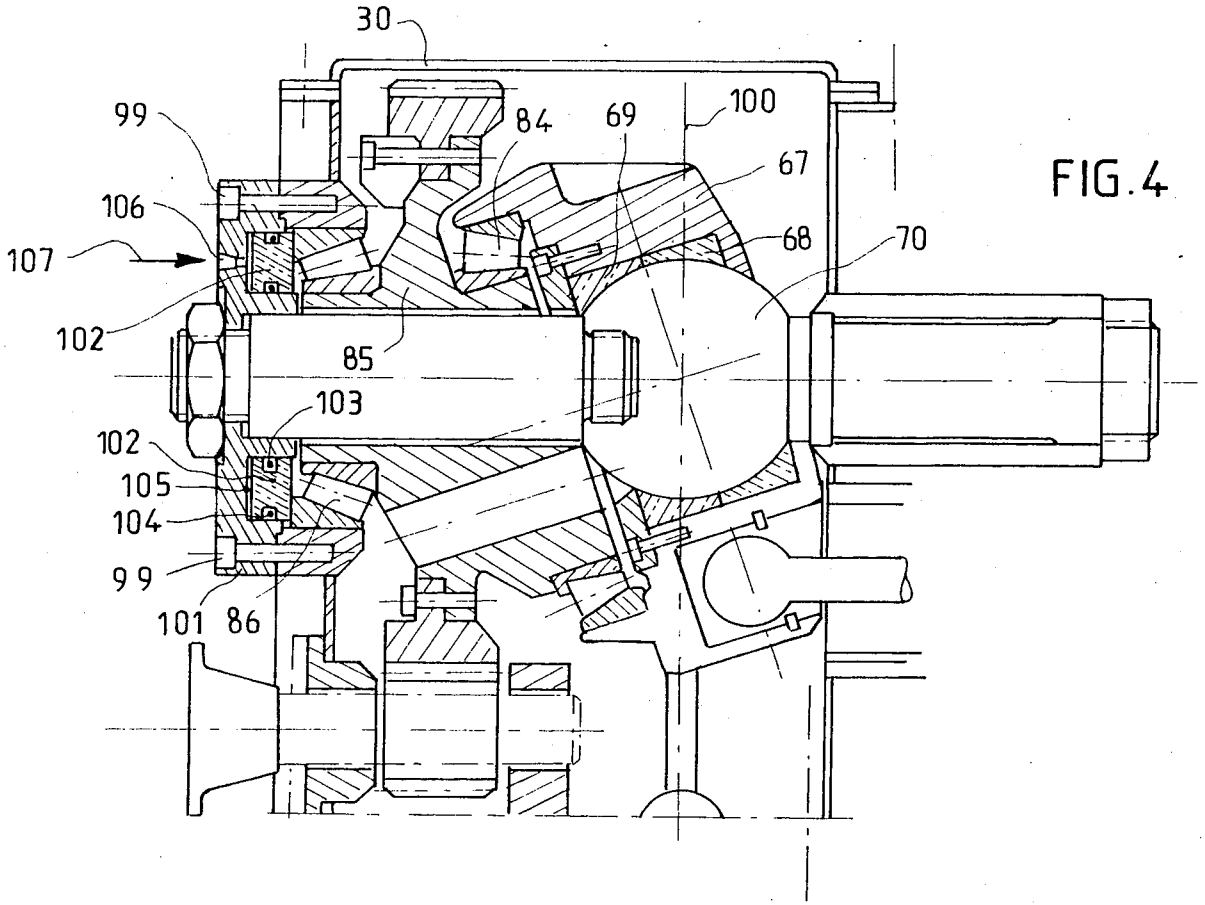
FIG. 4 shows a variant in which an annular hydraulic cylinder is installed at the back of the housing in order to prestress the second half-shaft supporting the central pivot.

In the variant of FIG. 4, instead of using the adjusting shim 87 and cover 75 arrangement of Figure 1, the axial compression prestressing of the thrust bearings 84, 86 is achieved by using a retainer cap 101 fastened to the housing 30 by screws 99. An annular hydraulic piston 102 can slide in the retainer cap 101. The piston 102 is equipped with two annular seal rings, i.e. a sliding internal ring 103 and an external sliding ring 104. The motor space 105 remaining between the annular piston 102 and the end of the cap 101, receives an hydraulic fluid under pressure represented by an arrow 107, through an inlet orifice 106. The unit is designed so that the minimum stroke of the hydraulic cylinder 101, 105 will correspond to a permanent minimum mechanical tightening point on the pivot of the thrust bearing 86.

This embodiment makes it possible to connect the operating pressure of the pump or compressor constituting the machine of the invention to the pressure exerted by the motor space 105 on the piston 102. A sensible choice of the useful area of the piston 102 will make it possible to control the stress applied on the thrust bearings 84 and 86 and thus on the spherical bearing 68, 69, so as to permanently achieve:

either a so-called 'floating thrust bearing' condition for the pivot 70;

or any desired amount ratio between the thrusts exerted on the pivot 70 on either side of the theoretical plane 100.

Figure 2:
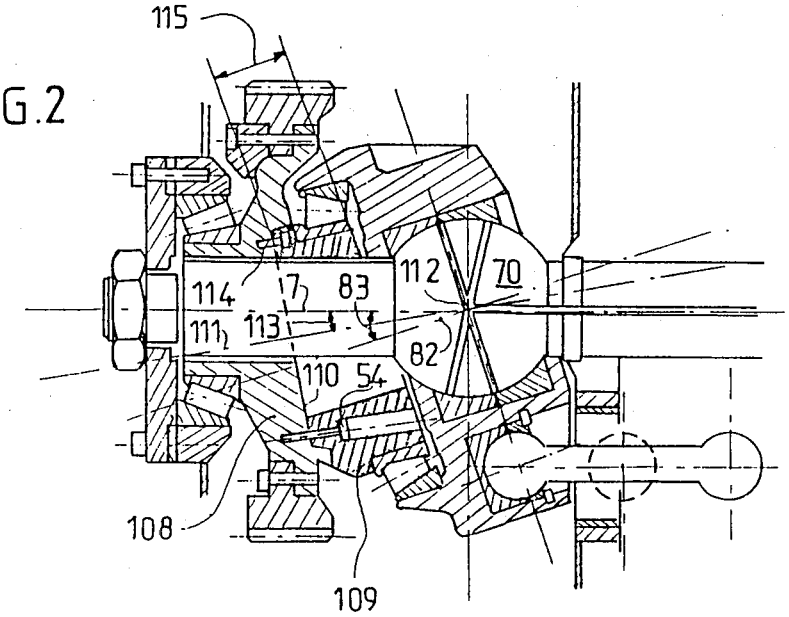
FIG. 2 is a partial view similar to FIG. 1 of a detail of the linkage, in which the two inclined half-plates are assembled in the position giving the maximum piston stroke.
Figure 3:
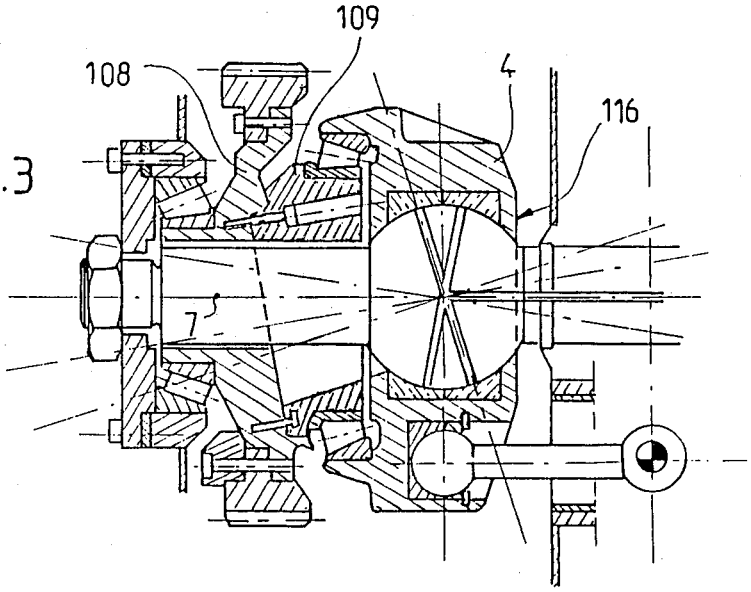
FIG. 3 is a view similar to FIG. 2 showing the two half-plates assembled in a zero stroke position.

In the partial views of FIGS. 2 and 3, the movement transmitter 85 is made in the form of two half-transmitters 108 and 109; each with a wedge-shaped profile. In other words, the flat bearing surface 110 along which the two half transmitters 108 and 109 are in contact is perpendicular to a theoretical axis 111 passing through the geometric center 112 of the pivot 70 and forming with the geometric axes 7 an angle 113 equal to half the aforesaid angle 83 for the axis 82. Screws 114, equally distributed in a circle around the axis 111, enable to assemble together the two half-transmitters 108 and 109.

It is apparent that by selecting the angular positions of the two half transmitters 108 and 109 around the axis 111 before fastening them with the screws 114, it is possible to define the length of the stroke thus imparted to the piston 64 (FIG. 5) for any intermediate value between:

the maximum stroke corresponding to the position illustrated in FIG. 2 (the thinnest area 115 of the half-transmitter 109 is then resting on a part of the half-transmitter 108 which is located the furthest back on the axis 7); and the zero stroke position, obtained by an offset of 180° relative to the position of FIG. 2, so as to orientate the front surface 116 of the plate 4 perpendicular to the lengthwise geometric axis 7.

In a more elaborate version, an externally-controlled continuous device controls the position of the two half-transmitters 108 and 109.

I claim:

1. A piston and barrel rotary machine comprising a thrust plate inclined with respect to a geometric rotation axis which is same as a geometric axis of the barrel, a central part of the inclined plate comprising a spherical bearing which freely rotates around a central fixed pivot, said central fixed pivot being fixed to a first half shaft directly anchored in a central part of the barrel, said barrel being connected to a peripheral housing covering a rear portion of linkage means, and wherein the central fixed pivot is also fixed to a second half shaft placed opposite the first half shaft with which it is aligned on a the geometric axis of the barrel, said second half shaft having an opposed end rigidly anchored onto a rear part of said housing.

2. The rotary machine as set forth in claim 1, wherein prestressing means for prestressing said spherical bearing are disposed between the rear part of said housing and roller thrust bearings, said roller thrust bearings being supported by said spherical bearing through a movement transmitter.

3. The rotary machine as set forth in claim 1, wherein said two half-shafts further comprises tensile screw means for taking up tensile stress on a front face of said barrel, thereby contributing to an overall rigidity of said housing during operation of the rotary machine.

4. The rotary machine as set forth in claim 2, wherein said prestressing means further comprises adjusting shim means disposed between a removable cover and a back portion of said housing for exerting a predetermined pressure on said roller thrust bearing.

5. The rotary machine as set forth in claim 1, wherein said inclined plate is further supported by a movement transmitter, said movement transmitter further comprising two half-transmitters superimposed with a generally wedge-shaped profile, fastening means for removably connecting said two wedged half-transmitters, said two wedged half-transmitters having an angular orientation selected, according to a desired stroke of said pistons, and within a range from maximum stroke to zero stroke.

6. The rotary machine as set forth in claim 1, wherein said first half-shaft freely passes through a longitudinal axial bore in said barrel and is further supported by an internal shoulder, a front end of said front half-shaft terminating in a threaded pin and nut means for adjusting the tensile stress of said first half-shaft by pressing on a front surface of said barrel.

7. The rotary machine as set in claim 1, wherein said two half-shafts are manufactured and then assembled.

8. The rotary machine as set forth in claim 1, wherein said two half-shafts are manufactured in a single piece.

9. A piston and barrel rotary machine comprising a thrust plate inclined with respect to a geometric rotation axis which is same as a geometric axis of the barrel, a central part of the inclined plate comprising a spherical bearing which freely rotates around a central fixed pivot, said central fixed pivot being fixed to a first half shaft directly anchored in a central part of the barrel, said barrel being connected to a peripheral housing covering a rear portion of linkage means, and wherein the central fixed pivot is also fixed to a second half shaft placed opposite the first half shaft with which it is aligned on the geometric axis of the barrel, said second half shaft having an opposed end rigidly anchored onto a rear part of said housing, prestressing means being disposed between the rear part of said housing and roller thrust bearings, with said roller thrust bearings being supported by said spherical bearing through a movement transmitter and wherein said prestressing means further comprises an annular coaxial hydraulic cylinder disposed between the rear part of said housing and a roller thrust bearing supporting a rear portion of said inclined plate.

10. The rotary machine as set forth in claim 9, wherein said annular coaxial hydraulic cylinder further comprises an inlet means connecting said cylinder to an operating pressure of the rotary machine.

* * * * *

UNITED STATES PATENT AND TRADEMARK OFFICE

CERTIFICATE OF CORRECTION

PATENT NO. : 4,815,327

DATED : March 28, 1989

INVENTOR(S) : DREVET

It is certified that error appears in the above-identified patent and that said Letters Patent is hereby corrected as shown below:

In the Abstract: line 4, delete "prstressed", insert therefor -- prestressed --

Column 2, line 63 Delete "71", insert therefor -- 91 --

Signed and Sealed this

Twenty-first Day of January, 1992

*Attest:*

HARRY F. MANBECK, JR.

*Attesting Officer*

*Commissioner of Patents and Trademarks*